US006302968B1

(12) United States Patent
Baum et al.

(10) Patent No.: US 6,302,968 B1
(45) **Date of Patent: *Oct. 16, 2001**

(54) PRECARBOXYLIC ACID RINSE METHOD

(75) Inventors: Burton M. Baum, Mendota Heights; Steven E. Lentsch, St. Paul; Thomas R. Oakes, Lake Elmo, all of MN (US)

(73) Assignee: Ecolab Inc., St. Paul, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/446,473

(22) Filed: May 22, 1995

Related U.S. Application Data

(63) Continuation-in-part of application No. 08/229,648, filed on Apr. 19, 1994.

(51) Int. Cl.[7] ..... B08B 3/00

(52) U.S. Cl. ..... 134/30; 134/15; 134/17; 134/23; 134/25.2; 134/26; 134/28; 134/34; 134/42

(58) Field of Search ..... 134/3, 6, 9, 15, 134/17, 22, 12, 22.14, 22.18, 23, 25.2, 26, 28, 30, 34, 42; 252/94, 95, 100, 186.1, 186.21, 186.22, 186.23, 186.42

(56) References Cited

U.S. PATENT DOCUMENTS

| | | |
|---|---|---|
| Re. 30,537 | 3/1981 | Fraula et al. . |
| 349,852 | 9/1886 | Marchand . |
| 1,772,975 | 8/1930 | Wieland . |

(List continued on next page.)

FOREIGN PATENT DOCUMENTS

| | | |
|---|---|---|
| 1 174 976 | 9/1984 | (CA) . |
| 1 937 682 | 1/1970 | (DE) . |
| 1 139 610 | 11/1962 | (DK) . |
| 0 021 504 | 1/1981 | (EP) . |
| 0 068 552 | 1/1983 | (EP) . |
| 0 083 820 | 7/1983 | (EP) . |
| 0 147 102 | 12/1983 | (EP) . |
| 0 097 995 | 1/1984 | (EP) . |
| 0 193 416 | 9/1986 | (EP) . |
| 0 218 441 | 4/1987 | (EP) . |
| 0 244 144 | 11/1987 | (EP) . |
| 0 245 928 | 11/1987 | (EP) . |
| 0 252 276 | 1/1988 | (EP) . |
| 0 288 689 | 11/1988 | (EP) . |
| 0 375 827 | 7/1990 | (EP) . |
| 2.122.284 | 9/1972 | (FR) . |
| 2.223.049 | 10/1974 | (FR) . |
| 1 135 643 | 12/1968 | (GB) . |
| 2 076 286 | 12/1981 | (GB) . |
| 2 103 089A | 2/1983 | (GB) . |
| 2 187 097A | 9/1987 | (GB) . |
| 2 189 394A | 10/1987 | (GB) . |
| 2 211 093A | 6/1989 | (GB) . |
| 59 157007 | 9/1984 | (JP) . |
| 59 16440 | 9/1984 | (JP) . |
| 62 048612 | 3/1987 | (JP) . |
| 62 270509 | 11/1987 | (JP) . |
| 1595431 | 9/1990 | (RU) . |
| WO 83/00163 | 1/1983 | (WO) . |
| WO 87/03799 | 7/1987 | (WO) . |
| WO 87/06470 | 11/1987 | (WO) . |
| WO 8808667 | 11/1988 | (WO) . |
| WO 91/05842 | 5/1991 | (WO) . |
| 91/15122 | 10/1991 | (WO) . |
| WO 9213987 | 8/1992 | (WO) . |

OTHER PUBLICATIONS

Derwent Publications Ltd., London, Great Britain, AN 86–229179 & JP–A–61 159 498 (KAO Corp.), Jul. 19, 1986.

Food Acidulants, pp. 7, 13, 44 and Chapter 8, pp. 97–114.

Kirk–Othmer Encyclopedia of Chemical Technology, Third Edition: Dicarboxylic Acids, vol. 7, p. 614–628.

Kirk–Othmer Encyclopedia of Chemical Technology, Third Edition: Carbonated Beverages, vol. 4, pp. 712–713.

Kirk–Othmer Encyclopedia of Chemical Technology, Third Edition: Citric Acid, vol. 6, pp. 150–178.

Kirk–Othmer Encyclopedia of Chemical Technology, Third Edition: Hydroxy Carboxylic Acids, vol. 13, pp. 80–120.

Kirk–Othmer Encyclopedia of Chemical Technology, Third Edition: Carboxylic Acids, vol. 4, pp. 814–834 and pp. 855–871.

Disinfection, Sterilization, and Preservation, Fourth Edition, Seymour S. Block, 1991, Chapter 47, "Chemical Food Preservatives".

Disinfection, Sterilization, and Preservation, Second Edition, Seymour S. Block, 1977, Chapter 16, "Acid–Anionic Surfactant Sanitizers".

code of Federal Regulations, 21 C.F.R. Ch. 1 (Apr. 1, 1991 Edition), pp. 311–318.

Kirk–Othmer, Encyclopedia of Chemical Technology, Third Edition, vol. 12, pp. 46, 61 and 62.

(List continued on next page.)

*Primary Examiner*—Arlen Soderquist
(74) *Attorney, Agent, or Firm*—Merchant & Gould P.C.

(57) ABSTRACT

The invention includes compositions and methods for sanitizing ware without staining, spotting or corroding. In its most preferred mode, the method comprises the steps of washing the ware in an automated ware washing machine and rinsing the ware at either high or low temperatures with a sanitizing rinse composition. The destaining, sanitizing concentrate composition preferably comprises peroxyacetic acid, acetic acid, and hydrogen peroxide using higher levels of acetic and peroxyacetic acid and a lower level of hydrogen peroxide. The sanitizing rinse composition may preferably be used at a concentration of peroxyacetic acid of at least 30 ppm.

10 Claims, No Drawings

U.S. PATENT DOCUMENTS

| | | | | |
|---|---|---|---|---|
| 2,466,663 | | 4/1949 | Russ et al. . | |
| 2,592,884 | | 4/1952 | Fox et al. . | |
| 2,592,885 | | 4/1952 | Fox et al. . | |
| 2,592,886 | | 4/1952 | Fox et al. . | |
| 2,833,813 | | 5/1958 | Wallace . | |
| 3,044,092 | | 7/1962 | Fox et al. . | |
| 3,146,718 | | 9/1964 | Fox et al. . | |
| 3,297,456 | | 1/1967 | Newell . | |
| 3,370,597 | | 2/1968 | Fox . | |
| 3,592,774 | | 7/1971 | Altensch pfer . | |
| 3,625,901 | | 12/1971 | Rue et al. . | |
| 3,650,965 | | 3/1972 | Cantor et al. . | |
| 3,867,300 | | 2/1975 | Karabinos et al. . | |
| 3,915,633 | | 10/1975 | Ramachandran . | |
| 3,941,713 | | 3/1976 | Dawson et al. . | |
| 4,002,775 | | 1/1977 | Kabara . | |
| 4,005,024 | | 1/1977 | Rodriguez et al. . | |
| 4,011,346 | | 3/1977 | Ernst . | |
| 4,051,058 | | 9/1977 | Böwing et al. . | |
| 4,051,059 | | 9/1977 | Böwing et al. . | |
| 4,147,559 | | 4/1979 | Fraula et al. . | |
| 4,187,121 | | 2/1980 | Herold et al. . | |
| 4,203,765 | | 5/1980 | Claeys et al. . | |
| 4,376,787 | | 3/1983 | Lentsch et al. . | |
| 4,404,040 | | 9/1983 | Wang . | |
| 4,406,884 | | 9/1983 | Fawzi et al. . | |
| 4,410,442 | | 10/1983 | Lucas et al. . | |
| 4,430,381 | | 2/1984 | Harvey et al. . | |
| 4,534,945 | | 8/1985 | Hopkins et al. . | |
| 4,557,935 | | 12/1985 | af Ekenstam et al. . | |
| 4,624,713 | | 11/1986 | Morganson et al. . | |
| 4,647,458 | | 3/1987 | Ueno et al. . | |
| 4,715,980 | | 12/1987 | Lopes et al. . | |
| 4,743,447 | * | 5/1988 | Le Rouzic et al. | 424/130 |
| 4,776,974 | | 10/1988 | Stanton et al. . | |
| 4,900,721 | | 2/1990 | Bansemir et al. . | |
| 4,920,100 | | 4/1990 | Lehmann et al. . | |
| 4,945,110 | | 7/1990 | Brokken et al. . | |
| 4,986,963 | * | 1/1991 | Corcoran et al. | 422/30 |
| 5,013,560 | | 5/1991 | Stentz et al. . | |
| 5,017,617 | | 5/1991 | Kihara et al. . | |
| 5,122,538 | * | 6/1992 | Lokkesmoe et al. | 514/557 |
| 5,200,189 | * | 4/1993 | Oakes et al. | 424/405 |
| 5,288,331 | * | 2/1994 | Rings et al. | 134/25.2 |
| 5,344,652 | * | 9/1994 | Hall, II et al. | 424/405 |
| 5,368,867 | * | 11/1994 | Da Silva et al. | 424/616 |
| 5,451,346 | * | 9/1995 | Amou et al. | 252/186.23 |

OTHER PUBLICATIONS

The Food Chemical News Guide, Oct. 7, 1991.
The Food Chemical News Guide, Jun. 26, 1989.
Clinical Toxicology of Commercial Products, Fifth Edition, Gosselin et al. Section III, Ethylene Glycol, 1984, p. 172.
Industrial Gums Polysaccharides and Their Derivatives, Whistler, Second Edition, Chapter XIX, Pectin, Towle et al, pp. 429–455.
Food Science and Technology, "A Series of Monographs, " Stewart et al, pp. 186–187.
Chemical Abstracts, Abstract No. 95723, vol. 111, p. 610, (Sep. 11, 1989).
Food Chemical Codex, Second Edition, Committee on Specification . . . , pp. 12–14, 1972.
Schick, "Nonionic Surfactants", published by Marcel Dekker and John L. Wilson, *Soap and Chemical Specialties*, Feb. 1958, Rinse Additives, pp. 48–52 and 170–171.
Solvent Properties of Surfactant Solutions, vol. 2, Frederic R. Benson, 1967 Nonionic Surfactants, pp. 260–297.
Research Note: Salmonella Decontamination of Broiler Carcases with Lactic Acid, L–Cysteine, and Hydrogen Peroxide by R.W.A.W. Mulder et al., pp. 1155–1557, Nov. 7, 1986.
17–Food, Feed Chem. vol. 108, 1988, 108:166345q Disinfectant compositions containing aqueous lower alcohol, acidic component, and amino– or ammonium–based microbicide, p. 549.
17–Food, Feed Chem. Vol. 111, 1989, 111:95723k Study of calcium binding to phosphoserine residues of –casin and its phosphopeptide (1–24) by $^{31}$P NMR.
63–Pharmaceuticals, vol. 102, 1985, 102:32300p Germ–killing materials.
63–Pharmaceuticals, vol. 70, 1969, 60796u Antibiotic and mucolytic compositions.
PCT International Search Report.

* cited by examiner

PRECARBOXYLIC ACID RINSE METHOD

CROSS-REFERENCE TO RELATED APPLICATIONS

This application is a continuation-in-part of application Ser. No. 08/229,648 filed Apr. 19, 1994.

SUMMARY OF THE INVENTION

The invention is a method and composition for sanitizing and rinsing ware articles used for the preparation, serving and consumption of food. The invention provides spot-free, film-free ware products upon rinsing with an added sanitizing effect. The invention may be used in either manual or automated washing and rinsing processes to provide a high level of sanitizing efficacy without the harmful drawbacks of certain other sanitizing agents such as halogens. Generally, the sanitizing agent of the invention comprises one or more carboxylic acids and peroxide to result in a composition which preferably comprises, at equilibrium, hydrogen peroxide, carboxylic acid, and peroxycarboxylic acid.

BACKGROUND OF THE INVENTION

In high volume institutional food preparation and service installations, chemical sanitizing compositions are often used in manual and automated ware washing processes to destroy bacteria during rinsing operations to meet minimum sanitation standards. In many installations sanitation standards are met through the use of very high temperature rinse water (180°–195° F.). Where such temperatures are not achievable, a chemical sanitizing agent is often added to one or more aqueous materials that contact kitchenware or tableware to produce a bacteria killing effect at the low temperature conditions of approximately 120–140° F. The use of the terms "high temperature" and "low temperature" herein relate approximately to the above temperature ranges.

Low temperature methods and equipment are illustrated in the following, Fox et al., U.S. Pat. Nos. 2,592,884, 2,592,885, and 2,592,886, 3,044,092 and 3,146,718, as well as Fox, U.S. Pat. No. 3,370,597. In large part, these machines follow a cleaning regimen wherein the soiled kitchenware or tableware can be prescraped either manually or with an automatic machine scraping stage involving a water spray to remove large bulk soil. The ware can then be directed to a zone wherein the ware is contacted with an aqueous alkaline cleaning composition that acts to remove soil by attacking protein, fat or carbohydrate soils chemically. The cleaned ware can be first rinsed and then be directed to a sanitizing stage wherein the ware is contacted with sanitizer material. Alternatively, the ware may be directed to a combined rinsing-sanitizing stage where the ware is contacted with a combination of rinse agent and sanitizer. Lastly, the ware can be directed to a stage where the articles are dried either actively by heating or passively by ambient evaporation.

The need for sanitization has lead to the consideration of various agents. One of the most common sanitizers for ware washing is aqueous sodium hypochlorite (NaOCl). However, while sodium hypochlorite is effective, low cost and generally available, sodium hypochlorite has several disadvantages. First, hypochlorite can react with hardness ions in service water including calcium, magnesium, iron, manganese, etc. Such chemical interaction can cause liming and mineral deposits on machine parts. Such deposits can tend to form in and on the water passages of a ware washing machine which can substantially change the flow rates of various aqueous materials through the machine. Any such change can seriously reduce the effectiveness of machine operation. Chlorine, as a constituent of sodium hypochlorite, may also present compatibility problems when used with other chemicals which have desirable sheeting and rinse aid characteristics, such as nonionic surfactants. Further, the interaction between sodium hypochlorite and various minerals in service water can result in the spotting and filming of ware products.

Sodium hypochlorite use tends to substantially increase the total dissolved solids present in aqueous sanitizing compositions. High concentrations of solids can tend to increase the tendency of agents to leave unwanted spotting and streaking upon drying. In fact, while chlorine has a noted sanitizing effect, the increased solids resulting from this constituent can film, spot and otherwise leave a residue on ware products subjected to the rinse. Chlorine may also react and degrade or corrode tableware comprising metals as well as metals found in the environment of use.

Sodium hypochlorite is also a strong oxidizing chemical and can substantially corrode a variety of materials used in machine manufacture and in tableware and kitchenware commonly used in today's institutional environment. Chlorine may also react and degrade or corrode tableware comprising silver or a silver plate finish. The degradation product is the reaction product of silver and other elemental ions in which the silver metal comes into contact. Silver rapidly compounds to form, for example, silver oxides and silver halogens, in particular silver chloride when exposed to chlorine from, for example, sodium hypochlorite.

In the meantime, various rinse aid compositions have been developed for use in both low temperature and high temperature wash systems. For example, Fraula et al., U.S. Pat. No. 4,147,559 and Reissue U.S. Pat. No. 30,537 teach an apparatus and a method for rinsing and chemically sanitizing foodware items. The disclosure is primarily directed to machine related components for ensuring adequate cleaning and sanitizing.

Further, a number of rinse aid compositions, based largely on nonionic surfactants without sanitizers are also known. Altenschopfer, U.S. Pat. No. 3,592,774, teaches saccharide-based nonionic rinsing agents. Rue et al., U.S. Pat. No. 3,625,901, teach surfactants used as rinse aids having low foaming properties. Dawson et al., U.S. Pat. No. 3,941,713, teach machine ware washing rinse agents having an anti-resoiling or non-stick additive for treating aluminum or other such metal kitchenware. Rodriguez et al., U.S. Pat. No. 4,005,024, teach a rinse aid composition containing organosilane and monofunctional organic acids that act as rinse agents. Herold et al., U.S. Pat. No. 4,187,121, teach a rinse agent concentrate based on saccharide glycol ether technology.

Further, Morganson et al., U.S. Pat. No. 4,624,713, teach a solidified rinse agent composition containing a nonionic rinsing agent, urea, water and other components. Surveys of nonionic surfactants and rinse additives containing nonionic surfactants are found in Schick, "Nonionic Surfactants", published by Marcel Dekker, and John L. Wilson, *Soap and Chemical Specialties*, February 1958, pp. 48–52 and 170–171.

However, none of these rinse aids have been able to combine effective sheeting and rinsing action with sanitizing efficacy. Accordingly, a strong need exists in the art to provide a rinsing sanitizing agent that can promote sheeting and prevent spotting, provide substantial sanitizing action, work safely within the environment, and result in operations without any substantial deposit formation on ware, dish machines or corrosion of machine components or kitchenware, tableware, and particularly ware products comprising silver.

While peroxyacid containing concentrates have been described in U.S. Pat. Nos. 4,051,058 and 4,051,059, these patents do not focus on the desired properties above described. The present invention provides for the use of an improved concentrate containing higher levels of peroxyacetic and acetic acid and a lower level of hydrogen peroxide.

BRIEF DESCRIPTION OF THE INVENTION

In accordance with a first aspect of the invention there is provided, a method of sanitizing and destaining ware comprising the step of applying a sanitizing, destaining concentrate composition comprising a peroxycarboxylic acid, a $C_{1-6}$ carboxylic acid, hydrogen peroxide, and a balance of carrier.

In accordance with a more preferred aspect of the invention, there is provided a method of sanitizing ware without creating a film residue comprising the steps of washing the ware in an automated ware washing machine, and rinsing the ware at a temperature ranging from about 120° F. to 140° F. with a sanitizing destaining concentrate composition comprising peroxyacetic acid, acetic acid, and hydrogen peroxide in an aqueous carrier. Optionally, the rinsing step may also comprise the introduction of a sheeting agent into the automated ware washing machine during the rinsing step or a combined product may be used where the sheeting agent is combined with the sanitizer.

In accordance with a still more preferred aspect of the invention, there is provided a method of sanitizing and destaining products comprising the step of applying to the ware an improved peroxyacetic acid concentrate composition wherein the initial mole ratio of acetic acid to hydrogen peroxide is less than 3:1, the mole ratio of acetic acid to peroxyacetic acid, at equilibrium, is less than 5:1, and wherein the composition is diluted upon application to a concentration of at least 40 ppm of peroxyacetic acid.

The term "silverware" or "silver plate" includes any of the "ware, tableware, kitchenware or dishware" that comprises silver, or a silver compound including silver salts, silver oxides, etc.

The invention is a method for destaining and sanitizing tableware. The invention generally comprises a peroxyacid material which optionally may be used in combination with effective sheeting agents that provide improved destaining and sanitization, but does not cause significant corrosion of machine parts or ware. We have found that the effective concentration of the materials result in low total solids formulations which substantially resist spotting. More specifically, as the sanitizing destaining concentrate composition of the invention comprises a peroxyacid, the composition generally evaporates from, rather than filming on, the ware subjected to the rinse. Also, the carboxylic acids to which the peroxy acids degrade are non-toxic and non-corrosive and are compatible with commonly available materials used in the manufacture of dish machines, kitchenware, tableware and glassware.

Finally, we have found that the present improved peroxyacetic acid concentrate composition containing higher levels of peroxyacetic acid and acetic acid and a lower level of hydrogen peroxide offers the following benefits:

1. Can be used at a lower concentration to deliver the same level of peroxyacetic acid in the use solution as the marketed product OXONIA described in U.S. Pat. No. 4,051,058. This results in lower use costs.
2. Yields a use solution of lower pH where peracids are known to be more effective biocides.
3. Less corrosive to silver in comparison to chlorine and OXONIA.
4. Has a lower active oxygen content and is therefore safer than OXONIA.

One of the problems encountered in using a peracid sanitizer in low temperature warewashing is that there is alkaline carry over from the detergent in the wash step to the rinse water. The present invention solves this problem by providing more acid to neutralize the alkalinity. Nevertheless, we have found that if the acetic acid to hydrogen peroxide ratio used in making the equilibrium formulations is too high, the resulting products are unstable. We have found that products made by starting with a mole ratio of acetic acid to hydrogen peroxide of less than 3:1 result in very stable formulations.

DETAILED DESCRIPTION OF THE PREFERRED EMBODIMENT

The invention is a method of sanitizing and destaining ware, including those utensils used in the preparation, serving, and consumption of food and foodstuffs. The method of the invention includes the application of a sanitizing concentrate comprising a peroxycarboxylic acid reaction product of one or more carboxylic acids and an oxidizer. Optionally the composition of the invention may also comprise oxidizer stable sequestrants and solubilizers as well as other adjuvants such as carriers, sheeting agents, etc. which are also stable in the presence of an oxidizer. These adjuvants may be premixed with the composition of the invention, as well as separately introduced into the environment of use simultaneously or after the rinse aid of the invention.

The concentrate of the invention is typically formulated in a liquid diluent compatible with the peroxyacid sanitizer and any rinse aids present in the composition. The uniqueness of the invention relates to the fact that the active components (1) are stable at substantial concentrations in the undiluted concentrate, (2) are significant improvements over the use of sodium hypochlorite in an aqueous rinse, (3) allow for effective sheeting in combination with a rinse aid and (4) yield improved ware appearance. Lastly, the compositions of the invention are non-corrosive in contact with materials common in the automatic dish machines and in ware.

For the purpose of this invention, the term "sheeting or rinse agent" refers to the chemical species that causes the aqueous rinse to sheet. The term "rinse aid" reflects the concentrated material which is diluted with an aqueous diluent to form the aqueous rinse. The terms "ware, tableware, kitchenware or dishware" refers to various types of articles subject to tarnish, discoloration or degradation used in the preparation, serving and consumption of foodstuffs including pots, pans, baking dishes, processing equipment, trays, pitchers, bowls, plates, saucers, cups, glass, forks, knives, spoons, spatulas, grills, griddles, burners and the like including those materials made from polymeric thermoplastics and thermosets, ceramics including fired and blown glasses, and elemental and alloyed metals such as silver, gold, bronze, copper, pewter, and steel among other materials. The term "rinsing" or "sheeting" relates to the capacity of the aqueous rinse when in contact with table ware to form a substantially continuous thin sheet of aqueous rinse which drains evenly from the ware leaving little or no spotting upon evaporation of the water.

The invention is concerned primarily with low temperature equipment in cleaning and sanitizing articles, but can be applicable to high temperature machines to provide an increased degree of confidence that ware are adequately destained and sanitized.

A. The Sanitizing, Destaining Concentrate

The compositions of the invention contain a peroxycarboxylic acid sanitizing composition. The peroxycarboxylic acid sanitizer material can comprise at least one monocarboxylic acid having from 1 to about 6 carbon atoms. Commonly, the peroxycarboxylic acid material can be made by oxidizing a monocarboxylic acid directly to the peracid material which is then solubilized in the aqueous concentrate compositions of the invention. Further, the materials can be made by combining the unoxidized acid with hydrogen peroxide to generate the acid in situ either prior to blending the fatty peroxyacid with the concentrate or after the concentrate is formulated.

Generally when the peroxycarboxylic acid is formulated in accordance with the invention, a monocarboxylic acid, such as acetic acid, is combined with an oxidizer such as hydrogen peroxide. The result of this combination is a reaction producing a peroxycarboxylic acid, such as peroxyacetic acid, and water. The reaction follows an equilibrium in accordance with the following equation:

$$H_2O_2+CH_3COOH\text{=====}CH_3COOOH+H_2O$$

wherein the $K_{eq}$ is about 2.0.

The importance of the equilibrium stems from the presence of hydrogen peroxide, the carboxylic acid and the peroxycarboxylic acid in the same composition at the same time. This combination provides enhanced sanitizing with none of the deleterious corrosive or tarnishing effects of other rinse agents, additives, or compositions.

The first constituent of the equilibrium mixture comprises one or more carboxylic acids. Generally, carboxylic acids have the formula R—COOH wherein the R may represent any number of different groups including aliphatic groups, alicyclic groups, aromatic groups, heterocyclic groups, all of which may be saturated or unsaturated as well as substituted or unsubstituted. Carboxylic acids also occur having one, two, three, or more carboxyl groups.

Carboxylic acids provide a precursor reactant to the peroxycarboxylic acid and acidify aqueous compositions in which they are present as the hydrogen atom of the carboxyl group is active. Moreover, the carboxylic acid constituent within the invention maintains the composition at an acidic pH which stabilizes and maintains the equilibrium concentration of peroxycarboxylic acid.

Specific examples of suitable $C_1$–$C_6$ carboxylic acids which can be used to make the peroxycarboxylic acid materials or to combine with hydrogen peroxide to form peroxyacid materials include such saturated fatty acids as methanoic, acetic acid, propionic acid, butyric acid, pentanoic, hexanoic acid, and mixtures thereof. Further, the carboxylic and peroxycarboxylic acids useful in this invention include $C_{1-6}$ carboxylic and peroxycarboxylic acids and derivatives thereof including acid-esters, acid salts, and shorter and longer chain acids present as contaminants.

These acids can be drawn from both natural or synthetic sources. Natural sources include animal and vegetable fats or oils which should be fully hydrogenated. Synthetic acids can be produced by the oxidation of petroleum wax. One carboxylic acid preferred for use in the composition of the invention comprises acetic acid or acetic acid as blended with other $C_{1-6}$ carboxylic acids. The preferred carboxylic acid is acetic acid which produces peroxycarboxylic acid to increase the sanitizing effectiveness of the materials.

The composition of the invention also comprises an oxidizer. Any number of oxidizers may be used as a precursor to the formation of a peroxycarboxylic acid. Generally, the antimicrobial composition of the invention comprises hydrogen peroxide. Hydrogen peroxide in combination with the carboxylic acid and peroxycarboxylic acid provides a surprising level of antimicrobial action against microorganisms, even in the presence of high loadings of organic sediment.

An additional advantage of hydrogen peroxide is the acceptability of these compositions on food contact surfaces, upon use and decomposition. For example, combinations of peroxyacetic acid and hydrogen peroxide result in acetic acid, water, and oxygen, upon decomposition. All of these constituents are food product compatible.

Hydrogen peroxide ($H_2O_2$), has a molecular weight of 34.014 and it is a weakly acidic, clear, colorless liquid. The four atoms are covalently bonded in a H—O—O—H structure. Generally, hydrogen peroxide has a melting point of −0.41° C., a boiling point of 150.2° C., a density at 25° C. of 1.4425 grams per cm3, and a viscosity of 1.245 centipoise at 20° C.

Generally, the concentration of hydrogen peroxide within the composition used in the process of the invention ranges from about 1 wt-% to about 50 wt-%, preferably from about 3 wt-% to about 40 wt-%, and most preferably from about 10 wt-% to about 30 wt-% in the concentrate, prior to use. This concentration of hydrogen peroxide is most preferred as providing optimal antimicrobial effect.

In all, altering the concentration of the oxidizing agent will effect the equilibrium mix of the peroxycarboxylic acid used in the invention.

The other principal component of the antimicrobial composition of the invention is an oxidized carboxylic acid. This oxidized or peroxycarboxylic acid provides heightened antimicrobial efficacy when combined with hydrogen peroxide and the monocarboxylic acid in an equilibrium reaction mixture. Percarboxylic acids generally have the formula $R(CO_3H)_N$, where R is an alkyl, arylalkyl, cycloalkyl, aromatic or heterocyclic group, and N is one or more.

While peroxy carboxylic acids are not very stable, their stability generally increases with increasing molecular weight. Thermal decomposition of these acids may generally proceed by free radical and nonradical paths, by photodecomposition or radical-induced decomposition, or by the action of metal ions or complexes. Percarboxylic acids may be made by the direct, acid catalyzed equilibrium action of 30–98 wt-% hydrogen peroxide with the carboxylic acid, by autoxidation of aldehydes, or from acid chlorides, or carboxylic anhydrides with hydrogen or sodium peroxide.

Peroxycarboxylic acids useful in this invention include $C_{1-6}$ peroxycarboxylic acids such as permethanoic peracetic acid, perpropanoic acid, perbutanoic acid, perpentanoic acid, perhexanoic acid and mixtures thereof. These percarboxylic acids have been found to provide good antimicrobial action with good stability in aqueous streams.

In a more preferred mode, the process of the invention uses peracetic acid. Peracetic acid is a peroxy carboxylic acid having the formula:

$$CH_3COOOH.$$

Generally, peracetic acid is a liquid having an acrid odor and is freely soluble in water, alcohol, ether, and sulfuric acid. Peracetic acid may be prepared through any number of means known to those of skill in the art including preparation from acetaldehyde and oxygen in the presence of cobalt acetate. A 50% solution of peracetic acid may be obtained by combining acetic anhydride, hydrogen peroxide and sulfuric acid. Other methods of formulation of peracetic acid include those disclosed in U.S. Pat. No. 2,833,813, which is incorporated herein by reference.

The preferred peroxyacetic acid materials of the invention can be used to increase the sanitizing effectiveness of the materials. When a blended acid is used, the peroxyacetic acid is blended in proportions that range from about 1 to about 50 parts of peroxyacetic acid per each part of other peroxycarboxylic acid. Preferably, the peroxyacetic acid is used at a ratio of about 8 parts per part of other peroxycarboxylic acid.

The above sanitizer material can provide antibacterial activity to the rinse aid sanitizers of the invention against a wide variety of microorganisms such as gram positive (for example, *Staphylococcus aureus*) and gram negative (for example, *Escherichia coli*) microorganisms, yeast, molds, bacterial spores, viruses, etc.

The composition of the invention also comprises a carrier. The carrier functions to provide a reaction medium for the solubilization of constituents and the production of percarboxylic acid as well as a medium for the development of an equilibrium mixture of oxidizer, percarboxylic acid, and carboxylic acid. The carrier also functions to deliver and wet the antimicrobial composition of the invention to the intended substrate.

To this end, the carrier may comprise any aqueous or organic component or components which will facilitate these functions. Generally, the carrier comprises water which is an excellent solubilizer and medium for reaction and equilibrium. Water is also readily accepted in ware washing environments. The carrier may also comprise any number of other constituents such as various organic compounds which facilitate the functions provided above.

Organics which can be useful include simple alkyl alcohols such as ethanol, isopropanol, n-propanol, and the like. Polyols are also useful carriers in accordance with the invention, including propylene glycol, polyethyleneglycol, glycerol, sorbitol, and the like. Any of these compounds may be used singly or in combination with other organic or inorganic constituents or, in combination with water or in mixtures thereof.

Generally, the carrier comprises a large portion of the composition of the invention and may essentially be the balance of the composition apart from the active antimicrobial composition, adjuvants, and the like. Here again, the carrier concentration and type will depend upon the nature of the composition as a whole, the environment of storage and method of application including concentration of the antimicrobial agent, among other factors. Notably the carrier should be chosen and used at a concentration which does not inhibit the antimicrobial efficacy of the active in the composition of the invention.

B. Adjuvants

The composition of the invention may also optionally comprise any number of adjuvants which are stable in an oxidizing environment, and add beneficial properties of stability, sequestration, sheeting and rinsing, etc. These adjuvants may be preformulated with the rinse aid of the invention or added to the system simultaneously, or even after, the addition of the rinse aid of the invention.

Stabilizer

The composition of the invention may also contain a polyvalent metal complexing or chelating agent that aids in reducing the harmful effects of hardness components and service water. The typically harmful effects of calcium, magnesium, iron, manganese, etc., ions present in service water can interfere with the action of either the washing compositions or rinsing compositions or can tend to decompose the active peroxygen sanitizer materials. The chelating agent or sequestering agent can effectively complex and remove such ions from inappropriate interaction with active ingredients thus increasing sanitizing performance.

Both organic and inorganic chelating agents may be used. Inorganic chelating agents include such compounds as sodium tripolyphosphate and other higher linear and cyclic polyphosphate species. Organic chelating agents include both polymeric and small molecule chelating agents. Small molecule organic chelating agents include salts of ethylene diamine tetraacetic acid, diethylene triamine penta acetic acid, nitrilotriacetic acid, ethylene diamine propionates, triethylene tetraamine hexacetates and the respective alkali metal, ammonium and substituted ammonium salts thereof. Polymeric chelating agents commonly comprise polyanionic compositions such as polyacrylic acid compounds. Amino phosphates and phosphonates are also suitable for use as chelating agents in the compositions of the invention and include ethylene diamine tetramethylene phosphonates, nitrilotrismethylene phosphonates, diethylenetriamine pentamethylene phosphonates. These amino phosphonates commonly contain alkyl or alkaline groups with less than 8 carbon atoms.

Preferred chelating agents for use in this invention include improved food additive chelating agents such as disodium salts of ethylene diamine tetraacetic acid or the well known phosphonates sold in the form of DEQUEST® materials, for example, 1-hydroxyethylidene-1,1-diphosphonic acid, etc. The phosphonic acid may also comprise a low molecular weight phosphonopolycarboxylic acid such as one having about 2–4 carboxylic acid moieties and about 1–3 phosphonic acid groups. Such acids include 1-phosphono-1-methylsuccinic acid, phosphonosuccinic acid and 2-phosphonobutane-1,2,4-tricarboxylic acid. Other organic phosphonic acids include those available from Monsanto Industrial Chemicals Co., St. Louis, Mo., such as DEQUEST® 2010, which is a 58–62% aqueous solution; amino [tri(methylenephosphonic acid)] ($N[CH_2PO_3H_2]_3$), available from Monsanto as DEQUEST® 2000, as a 50% aqueous solution; ethylenediamine [tetra (methylenephosphonic acid)] available from Monsanto as DEQUEST® 2041, as a 90% solid acid product; and 2-phosphonobutane-1,2,4-tricarboxylic acid available from Mobay Chemical Corporation, Inorganic Chemicals Division, Pittsburgh, Pa., as Bayhibit AM, as a 45–50% aqueous solution.

The above-mentioned phosphonic acids can also be used in the form of water soluble acid salts, particularly the alkali metal salts, such as sodium or potassium; the ammonium salts or the alkylol amine salts where the alkylol has 2 to 3 carbon atoms, such as mono-, di-, or tri-ethanolamine salts. If desired, mixtures of the individual phosphonic acids or their acid salts can also be used.

Rinse Agent

A component which may be added to or used with the composition of the invention is a rinse agent such as a surfactant system used to promote sheeting. Generally, any number of surfactants may be used consistent with the purpose of this constituent. For example the surfactant rinse agent may comprise a nonionic, anionic, cationic, or amphoteric surfactant.

These surfactant rinse aids may be present in the sanitizing, destaining concentrate of the invention as formulated. Alternatively, these rinse agents may be introduced during application to the ware. In such an instance, regardless of whether automated or manual, the rinse agent may be combined with the concentrate of the invention prior to application or codispensed separately during application.

Anionic surfactants useful with the invention comprise alkyl carboxylates, linear alkylbenzene sulfonates, paraffin sulfonates and secondary n-alkane sulfonates, sulfosuccinate esters and sulfated linear alcohols.

Zwitterionic or amphoteric surfactants useful with the invention comprise β-N-alkylaminopropionic acids, n-alkyl-β-iminodipropionic acids, imidazoline carboxylates, n-alkylbetaines, amine oxides, sulfobetaines and sultaines.

Generally, these surfactants find preferred use in manual applications. The choice of surfactants depends on the foaming properties that the individual, or combination, of surfactants bring to the composition of the invention.

Nonionic surfactants useful in the context of this invention are generally polyether (also known as polyalkylene oxide, polyoxyalkylene or polyalkylene glycol) compounds. More particularly, the polyether compounds are generally polyoxypropylene or polyoxyethylene glycol compounds. Typically, the surfactants useful in the context of this invention are synthetic organic polyoxypropylene (PO)-polyoxyethylene (EO) block copolymers. These surfactants comprise a diblock polymer comprising an O block and a PO block, a center block of polyoxypropylene units (PO), and having blocks of polyoxyethylene grafted onto the polyoxypropylene unit or a center block of EO with attached PO blocks. Further, this surfactant can have further blocks of either polyoxyethylene or polyoxypropylene in the molecule. The average molecular weight of useful surfactants ranges from about 1000 to about 40,000 and the weight percent content of ethylene oxide ranges from about 10–80% by weight.

Also useful in the context of this invention are surfactants comprising alcohol alkoxylates having EO, PO and BO blocks. Straight chain primary aliphatic alcohol alkoxylates can be particularly useful as sheeting agents. Such alkoxylates are also available from several sources including BASF Wyandotte where they are known as "Plurafac" surfactants. A particular group of alcohol alkoxylates found to be useful are those having the general formula $R\text{-}(EO)_m\text{-}(PO)_n$ wherein m is an integer of about 2–10 and n is an integer from about 2–20. R can be any suitable radical such as a straight chain alkyl group having from about 6–20 carbon atoms.

Other useful nonionic surfactants of the invention comprise capped aliphatic alcohol alkoxylates. These end caps include but are not limited to methyl, ethyl, propyl, butyl, benzyl and chlorine. Preferably, such surfactants have a molecular weight of about 400 to 10,000. Capping improves the compatibility between the nonionic and the oxidizers hydrogen peroxide and percarboxylic acid, when formulated into a single composition. An especially preferred nonionic is Plurafac LF131 from BASF with a structure $C_{12\text{-}7}(EO)_7(BO)_{1.7}R$ wherein R is a $C_{1\text{-}6}$ alkyl moiety and preferably with 60% of the structures being methyl capped, R comprises $CH_3$. Other useful nonionic surfactants are alkylpolyglycosides.

Another useful nonionic surfactant of the invention comprises a fatty acid alkoxylate wherein the surfactant comprises a fatty acid moiety with an ester group comprising a block of EO, a block of PO or a mixed block or heteric group. The molecular weights of such surfactants range from about 400 to about 10,000, a preferred surfactant comprises an EO content of about 30–50 wt-% and wherein the fatty acid moiety contains from about 8 to about 18 carbon atoms.

Similarly, alkyl phenol alkoxylates have also been found useful in the manufacture of the rinse agents of the invention. Such surfactants can be made from an alkyl phenol moiety having an alkyl group with 4 to about 18 carbon atoms, can contain an ethylene oxide block, a propylene oxide block or a mixed ethylene oxide, propylene oxide block or heteric polymer moiety. Preferably such surfactants have a molecular weight of about 400 to about 10,000 and have from about 5 to about 20 units of ethylene oxide, propylene oxide or mixtures thereof.

Solubilizer

The compositions of the invention may also include a hydrotrope coupler or solubilizer. Such materials can be used to ensure that the composition remains phase stable and in a single highly active aqueous form. Such hydrotrope solubilizers or couplers can be used in compositions which maintain phase stability but do not result in unwanted compositional interaction.

Representative classes of hydrotrope solubilizers or coupling agents include an anionic surfactant such as an alkyl sulfate, an alkyl or alkane sulfonate, a linear alkyl benzene or naphthalene sulfonate, a secondary alkane sulfonate, alkyl ether sulfate or sulfonate, an alkyl phosphate or phosphonate, dialkyl sulfosuccinic acid ester, sugar esters (e.g., sorbitan esters) and a $C_{8\text{-}10}$ alkyl glucoside.

Preferred coupling agents for use in the rinse agents of the invention include n-octane sulfonate and aromatic sulfonates such as an alkyl benzene sulfonate (e.g., sodium xylene sulfonate or naphthalene sulfonate). Many hydrotrope solubilizers independently exhibit some degree of antimicrobial activity at low pH. Such action adds to the efficacy of the invention but is not a primary criterion used in selecting an appropriate solubilizing agent. Since the presence of the peracid material in the protonated neutral state provides beneficial biocidal or sanitizing activity, the coupling agent should be selected not for its independent antimicrobial activity but for its ability to provide effective single phase composition stability in the presence of substantially insoluble peracid materials and the more soluble compositions of the invention.

C. Formulation

The compositions of the invention can be formulated by combining the rinse agent materials including other adjuvant components with the materials that form the sanitizer composition, the carboxylic acid or acid blend, hydrogen peroxide and optionally, hydrotrope solubilizer.

The compositions can also be formulated with preformed peroxy acids. The preferred compositions of the invention can be made by mixing the carboxylic acid or mixture thereof with an optional hydrotrope solubilizer or coupler, reacting the mixture with hydrogen peroxide and then adding the balance of required ingredients to provide rinsing and sanitizing action.

A stable equilibrium mixture is produced containing the carboxylic acid or blend with hydrogen peroxide and allowing the mixture to stand for 1–7 days at 15° C. or more. With this preparatory method, an equilibrium mixture will be formed containing an amount of hydrogen peroxide, unoxidized acid, oxidized or peracid and typically unmodified couplers, solubilizer, or stabilizers.

D. Concentrated Use Compositions

The invention contemplates a concentrate composition which is diluted to a use solution prior to its utilization as a sanitizer. Primarily for reasons of economics, the concentrate would normally be marketed and an end user would preferably dilute the concentrate with water or an aqueous diluent to a use solution.

The general constituent concentrations of the sanitizer concentrate formulated in accordance with the invention may be found in the Table below.

TABLE

| Constituent | CONCENTRATE (wt-%) -at Equilibrium- Preferred | More Preferred | Most Preferred |
|---|---|---|---|
| $H_2O_2$ | 1–50 | 3–40 | 10–30 |
| Peroxy acid | 0.5–25 | 1–20 | 3–15 |
| Carboxylic acid | 2–70 | 5–50 | 5–40 |
| Stabilizer | 0–5 | 0.7–4 | 0.8–1.5 |
| Solubilizer | 0–20 | 0–15 | 0–10 |
| Rinse Agent | 0–40 | 5–35 | 10–30 |
| Carrier | Balance | Balance | Balance |

The level of active components in the concentrate composition is dependent on the intended dilution factor and the desired activity of the surfactant and peroxy fatty acid compound and the desired acidity in the use solution. In the typical use locus, the concentrate is diluted with a major proportion of water and used for destaining and sanitizing using commonly available tap or service water.

At equilibrium, aqueous antimicrobial sanitizing, and destaining solutions contain at least about 1 part per million of peroxyfatty acid. In general the concentration of the use solutions may be of the range as illustrated in the following Table.

TABLE

| Constituent | USE SOLUTION (ppm) -at Equilibrium- Preferred | More Preferred | Most Preferred |
|---|---|---|---|
| $H_2O_2$ | 1.5–750 | 15–600 | 15–300 |
| Peroxy acid | 1–500 | 10–400 | 10–200 |
| Carboxylic acid | 3–2000 | 30–1600 | 30–800 |
| Surfactant Rinse Aid | 5–300 | 10–200 | 15–150 |

In the still more preferred aspect of the present invention where an improved peroxyacetic acid concentrate composition is employed, formulations, sometimes referred to hereinafter as "modified OXONIA" formulations, are designed to deliver higher levels of peracetic and acetic acids and a lower level of hydrogen peroxide as compared to the known marketed product OXONIA. It has been surprisingly found that when the initial molar ratio of acetic acid to hydrogen peroxide exceeds 3:1, formulations have poor stability. Thus, the optimum formulations comprise those where the initial acetic acid to hydrogen peroxide molar ratio is less than 3:1 and the acetic acid to peracetic acid molar ratio at equilibrium is less than 5:1. By way of example, formulation at equilibrium may contain:

| Constituent | CONCENTRATE (wt-%) -at Equilibrium- Preferred | More Preferred |
|---|---|---|
| Peroxyacetic acid | 5–12 | 6–9 |
| Acetic acid | 17–36 | 18–21 |
| Hydrogen Peroxide | 8–16 | 13–16 |

In use, the composition of the invention may be combined with a surfactant rinse aid. The surfactant rinse aid may be used in the described environment at the following concentrations (wt-%).

| | Preferred | More Preferred |
|---|---|---|
| Surfactant Rinse Aid | 0.0005–0.03 | 0.001–9.02 |

E. Methods of Use

As noted above, compositions of the invention are useful in rinsing steps of manual washing procedures as well as commonly available ware washing machines.

The sanitizing destaining concentrate of the invention may be used in any manual procedure known to those of skill in art. One example of such a procedure is a three tub washing procedure for washing, rinsing, and sanitizing ware. Generally such procedures take place at temperatures ranging from about 20° C. to 35° C.

While the configuration and construction of ware washing machines do vary from high temperature to low temperature machines and from manufacturer to manufacturer, all machines share common operating parameters in that the aqueous rinse compositions are sprayed on dishes in a rinse step at a generally fixed temperature for a generally fixed period of time. In such machines, the aqueous rinse composition is prepared by diluting rinse agent with an appropriate proportion of water, placing the aqueous rinse in a sump or other container and drawing and spraying the aqueous rinse from the sump. Such aqueous rinses often sprayed through nozzles attached to rotating bars or fixed sprayer nozzles attached or installed in the ware washing machine in a location that optimizes contact between the aqueous rinse and ware.

The nozzles are often manufactured with a geometry that enhances a spray pattern for complete coverage. The spray arms can be fixed or can reciprocate or rotate within the machine providing complete coverage. The aqueous diluted concentrate of the invention in a low temperature machine can be pumped at a rate of about 20 to 100, preferably 40 to 80 gallons per minute and is commonly contacted with dishes at temperatures between 120 and 140° F. In a high temperature machine, the aqueous rinse is sprayed at a rate of 1.0–2.5 gallons per rack of dishes at a temperature of about 150 to 190° F. The rinse cycle can extend in time for from about 7 to about 30 seconds, preferably about 10 to 20 seconds to ensure that the dishes are both fully rinsed and sanitized in the rinsing stage. The term "sanitizing" is used in the description and methods of the invention indicates a reduction in the population of numbers of undesirable microorganisms by 5 orders of magnitude or greater (99.999% reduction) after a 30 second exposure time. In other words, 99.999% of the microbial population present in a test site are eliminated by using the composition of the invention, as measured by Germicidal and Detergent Sanitizing Action of Disinfectants, Official Methods of Analysis of the Association of Official Analytical Chemists, paragraph 960.09, and applicable subparagraphs, 15th Edition.

The above formulations were found to be very stable at ambient temperatures and also at about 100° F. Stability data for a number of representative examples of modified OXONIA formulations are shown in the Working Examples section.

Microbiological studies carried out at various temperatures showed that certain formulations comprising the improved peroxyacetic acid concentrate (modified OXONIA) of the present invention provide greater than 5 log reduction of *Staphylococcus aureus* and *E. coli* at a lower concentration in the standard AOAC sanitizing test than OXONIA under the same conditions. The following Table illustrates such results.

TABLE

CONCENTRATION REQUIRED TO ACHIEVE >5 LOG KILL OF *Staphylococcus aureus* and *E. coli*

| | FORMULATION | | | |
|---|---|---|---|---|
| | OXONIA | | MODIFIED OXONIA* | |
| TEMPERATURE | PERACETIC ACID (ppm) | CONCENTRATE (oz/gal) | PERACETIC ACID (ppm) | CONCENTRATE (oz/gal) |
| 25° C.(78° F.) | 110 | 1 oz/4 gal | 85 | 1 oz/6 gal |
| 130° F. | 42 | 1 oz/10 gal | 33 | 1 oz/16 gal** |
| 140° F. | 35 | 1 oz/12 gal | 33 | 1 oz/16 gal** |

*The representative formulation was that described as Formulation 2 in Working Example 5
**Lowest level tested.

Finally, experiments also carried out in a low temperature warewash machine in which silver plated spoons and knives were washed, showed that OXONIA, when used as the sanitizer at a concentration as low as 1 oz/16 gal (25 ppm peracetic acid) caused corrosion after 10 cycles, whereas a representative formulation comprising the improved peroxyacetic acid (modified OXONIA) had a concentration of 1 oz/12 gal (about 45 ppm peracetic acid) did not show any evidence of corrosion.

The peroxyacetic acid concentrate of the present invention can be used wherever OXONIA is used today. This includes use as an acid liquid sanitizer for food processing equipment in dairies, dairy farms, breweries, wineries, beverage and food processing plants. It could also be used as a disinfectant in hospitals, health care facilities, veterinary facilities, farms, livestock quarters, poultry premises, and poultry hatcheries. Specific applications include a final sanitizing bottle rinse; disinfection of poultry premises, trucks, coops and crates; poultry hatchery disinfection; sanitizing hatching eggs; sterilization of manufacturing filling and packaging equipment in aseptic processes; a third sink sanitizer; and as a biocide in the water used for vegetable and chicken processing. This invention should also have virucidal and tuberculocidal properties.

WORKING EXAMPLES

The following examples are intended to illustrate the invention and should not be construed to narrow its scope. One skilled in the art will readily recognize that these examples suggest many other ways in which the invention can be practiced.

Working Example 1

A rinse agent composition was prepared by blending 0.79 gram of a rinse agent composition comprising an aqueous rinse aid comprising 10 wt-% LF 428 (benzyl capped linear alcohol ethoxylate), 10 wt-% D 097 (a EO/PO block copolymer terminated with PO), 1 wt-% of a nonyl phenol ethoxylate having 9.5 moles of ethylene oxide, 0.1 wt-% of ethylene diamine tetraacetic acid sodium salt, 0.08 wt-% of a 37 wt-% active aqueous formaldehyde solution, 14 wt-% of a sodium xylene sulfonate (40 wt-% active aqueous solution) and 0.015 wt-% of a green dye blended with a material selected from the group consisting of 6.23 grams of sodium hypochlorite (9.8 wt-% active aqueous NaOCl) (Example 1A), 13.4 grams of peracetic acid preparation (Example 1B) or 6.7 grams of a peracetic acid preparation (Example 1C). The peracetic acid preparation comprises 28.3 wt-% of hydrogen peroxide, 8 wt-% of acetic acid, 5.8% peracetic acid, 0.9 wt-% of a phosphonate stabilizer comprising hydroxyethylidene diphosphonic acid and the balance being water.

These three materials were used in a machine ware washing experiment wherein drinking glasses were washed and rinsed. A wash cycle was used in which 7.37 grams of a commercial dishwashing detergent was introduced into the wash cycle. In conducting the experiment, city water having 125 ppm total dissolved solids and softened well water containing 255 ppm total dissolved solids were used. In each experiment a 20 cycle machine evaluation with 10 minutes dry time between cycles was used. Glasses were evaluated at the end of 20 cycles for film and spots, although filming was taken to be a more reliable indicator of glass appearance in the test. Heavily filmed glasses do not show spots well because a heavy film prevents appearance of spots. In these tests the dish machine has a 1.7 gallon sump. Into each batch of wash water was added 2.14 grams of pureed beef stew soil and 1.07 grams of "hot point" soil. A set of test glasses (during the 20 cycle test) was dipped into whole milk and dried at 100° F. for 10 minutes between each cycle. The other set of glasses was not dipped into milk, but allowed to air dry between cycles. The milk soiled glass duplicates the soiling and drying of soil experienced in restaurant conditions. Water temperature was maintained between 130–140° F. Each glass was graded by three separate graders. Filming was graded in a dark room black box and the results are the consensus value of the three film grade criteria are as follows: no film=1.0; trace of film=2.0; light film visible under normal lighting conditions=3.0; moderate film=4.0; and heavy film=5.0.

TABLE I

Film results for the 20 cycle tests are as follows:

| SANITIZER | FILM GRADES Softened Grade | | City Grade | |
|---|---|---|---|---|
| Example 1 (a) with sodium hypochlorite | with milk | 4.0 | with milk | 3.7 |
| | w/o milk | 3.5 | w/o milk | 2.5 |
| Example 1 (b) with peracetic acid (high dose) | with milk | 1.0 | with milk | 1.6 |
| | w/o milk | 1.6 | w/o milk | 1.4 |
| Example 1 (c) with peracetic acid (low dose) | with milk | 1.7 | with milk | 1.9 |
| | w/o milk | 1.7 | w/o milk | 1.9 |

An examination of the data shown in Table I demonstrates that the use of chlorine bleach in a rinse agent results in substantial filming on common glassware. The use of a peracetic acid hydrogen peroxide sanitizer in combination with a low foaming rinse agent produces substantially improved filming when compared with the hypochlorite based rinse sanitizer system.

Working Example 2

A further analysis of the antimicrobial nature of the invention was undertaken using the Germicidal and Detergent Sanitizer Test, (Official Final Action, A.O.A.C. Methods of Analysis 15th Edition, 1990, 960.09 A–J). The test system was prepared by aseptically adding 5 ml of phosphate buffer to a 24 hr. agar slant of each test system. The growth was washed off and rinsed back into phosphate buffer. The suspension was then mixed well and 2 ml of this suspension was placed onto each French slant. The slants were tilted back and forth to completely cover the surface. The excess suspension was decanted off and the slants were incubated at 37° C. for 18–24 hours.

After incubation, the test system was removed from the French slant agar surface by adding 3 ml phosphate buffer and sterile glass beads. The beads were then rotated back and forth to remove the growth. The suspension was filtered through Buchner Funnel with Whatman No. 2 filter paper and collected in a sterile test tube. Standardization of both test systems was performed on spectrophotometer at 580 nm. Standardization was as follows:

| *S. aureus* |
|---|
| Initial %T = 0.3.<br>24 ml of phosphate buffer was then added.<br>Final %T = 1.2. |

A test substance was prepared for testing in this case. The test substance had the following composition:

| constituent | wt-% |
|---|---|
| peroxyacetic acid | 5.25 |
| hydrogen peroxide | 24.15 |
| inert ingredients (including carrier) | 70.60 |

In operation, 100 ml of prepared test substance was dispensed into a 100 ml volumetric and 1 ml was removed. This 99 ml was dispensed into a sterile 250 ml erlenmeyer flask, placed into a 120° F. (48.89° C.) water bath and allowed to equilibrate for 10 minutes. Then, 1 ml of test system was added to flask while swirling. After a 30 second exposure, 1 ml was transferred into 9 ml neutralizer. Samples were enumerated using serial dilutions. Incubation was at 37° C. for 48 hours.

The neutralizer was prepared with 1% sodium thiosulfate, (J.T. Baker Chemical Co., Phillipsburg, N.J.), 1% Peptone, (Difco Laboratories, Detroit, Mich.); and 1 g Sodium Thiosulfate+1 g Peptone/90 ml distilled water. This was dispensed and autoclaved as concentrated Thiopeptone. Also added was 0.025% Catalase, (Sigma Chemical Co., St. Louis, Mo.).

On the test date, 0.025% Catalase was prepared by adding 0.125 g Catalase into 50 ml water. This solution was filter sterilized through a 0.45 μm filter. Then, 10 ml of 0.025% Catalase was added to 90 ml Thiopeptone and mixed. 9 ml of this solution was dispensed into 25 mm×150 mm test tubes to be used as the neutralizer.

TABLE II

RESULTS

Test Temperature: 120° F. (48.89° C.)±0.2° C./Test Exposure

Time: 30 seconds

Plating Medium: Trypticase Glucose Extract Agar

Difco Laboratories, Detroit, Mich.

Percent Reduction(%R)=Initial Inoculum-Survivor Numbers×100 Initial Inoculum

| *Staphylococcus aureus* ATCC 6538 | | | | |
|---|---|---|---|---|
| Example | Test Water | Initial Inoculum (cfu/ml) | Survivors Numbers (cfu/ml) | Percent Reduction |
| 2A | 500 ppm | $7.97 \times 10^7$ | <10 | 99.999 |
| 2B | 500 ppm | $7.97 \times 10^7$ | <10 | 99.999 |

| *Escherichia coli* ATCC 11229 | | | | |
|---|---|---|---|---|
| Example | Test Water | Initial Inoculum (cfu/ml) | Survivors Numbers (cfu/ml) | Percent Reduction |
| 2A | 500 ppm | $1.01 \times 10^8$ | <10 | 99.999 |
| 2B | 500 ppm | $1.01 \times 10^8$ | <10 | 99.999 |

CONCLUSION

The test substance at a concentration of 1 oz/8 gallons which is 0.098% (1.96 ml product in 1998.04 ml diluent) diluted in 500 ppm synthetic hard water (as $CaCO_3$), has been shown to be an effective sanitizer on inanimate food contact surfaces against *Staphylococcus aureus* and *Escherichia coli* by yielding a 99.999% reduction within a 30 second exposure time at 120° F. (48.89° C.).

Working Example 3

Corrosion Experiments

A series of experiments were carried out to measure the relative corrosive action of hypochlorite solutions versus the concentrate composition of the invention on stainless steel. In one series of tests, these solutions were dripped onto hot stainless steel to simulate what one sees in the field when a feed line breaks, causing the undiluted solution to drip onto the outside of the hot warewashing machine. Two 8×8 inch panels, one made of 304 stainless steel and the other from 316 stainless steel, were each divided into four sections and placed in an oven at 100° F. Each section of each plate was treated with 10 drops of one of the following solutions daily.

| EXAMPLE | COMPOSITION |
|---|---|
| COMPARATIVE EXAMPLE 3A | Hypochlorite solution of 6.0% Available Chlorine |
| COMPARATIVE EXAMPLE 3B | Hypochlorite solution of 4.8% Available Chlorine |
| COMPARATIVE EXAMPLE 3C | Hypochlorite solution of 2.1% Available Chlorine |
| WORKING EXAMPLE 3A | Peracetic Acid solution of 5% Peracetic Acid |

The panels were treated in this manner over a period of two months. The panels were rinsed with water at the end of each week during this period and observed. At the end of two weeks, the section of both panels treated with the hypochlorite solutions (Comparative Examples 3A–3C) began to corrode, but the sections treated with the peracetic acid solutions (Working Example 3A), did not.

Over the two month period, the hypochlorite treated surfaces grew progressively worse and exhibited brown discolorations and pitting whereas the peracetic acid treated surfaces showed no change except for a slight lightening.

Working Example 4

An example of the destaining capability of the sanitizer was demonstrated using a Hobart ET-40 double rack dish machine and softened water at a temperature between 120°–140° F. The peracid sanitizer was the same as that specified in Example 1B. This concentration works out to be 23 ml per rinse cycle.

At the beginning of the test, the coffee and tea cups were badly stained. The test was conducted for one week. During this time, the coffee and tea cups were used and washed in the normal manner. At the end of the one week test, the coffee and tea cups were examined and found to have been destained.

The above specification, examples and data provide a complete description of the manufacture and use of the composition of the invention.

Working Example 5

Table III shows the formulations for the marketed product OXONIA (1a) and the "modified OXONIA" formulations, Formulations 2–11, which are representative formulations in accordance with the peroxyacetic acid concentrate composition of the present invention.

The formulations were prepared by adding to acetic acid the items in the order listed with slow agitation. When all of the items were added, the mixture was agitated for an additional 15 minutes.

The mixture was titrated for hydrogen peroxide and peroxyacetic acid after two days and after a week. Following equilibration of the mixtures, samples were taken from each formulation for stability testing. A set of samples, formulations 1(a)–4, were kept at room temperature for a year and titrated each quarter. The stability studies are reported in Table III(a).

The subsequent working examples refer to the OXONIA formulation or Formulation 1(a) and the modified OXONIA formulations in the reported efficacy and comparison studies.

TABLE III

| MODIFIED OXONIA FORMULATIONS | | | | |
|---|---|---|---|---|
| FORMULATION: | 1(a) | 2 | 3 | 4 |
| ACETIC ACID | 11.2 | 25 | 23 | 25 |
| H202 (35%) | 84.8 | 50 | 52 | 45 |
| DEQUEST 2010 | 1.6 | 1.0 | 1.0 | 1.0 |
| H2O | 2.4 | 24 | 24 | 29 |
| AA/H202 (MOLES) | 0.2 | 0.8 | 0.7 | 0.9 |
| EQUILIBRIUM CONCENTRATION, % CALCULATED (b) | | | | |
| ACETIC ACID | 7.0 | 19.8 | 18.1 | 20.1 |
| H202 (100%) | 27.3 | 14.6 | 15.4 | 13.1 |
| H2O | 59.4 | 58.5 | 59.3 | 59.7 |
| PAA | 5.4 | 6.6 | 6.3 | 6.0 |
| AO | 13.9 | 8.3 | 8.5 | 7.5 |
| AA/PAA (MOLES) | 1.6 | 3.8 | 3.6 | 4.3 |
| EQUILIBRIUM CONCENTRATION, % FOUND (c) | | | | |
| H202 (100%) | 26.5 | 14.2 | 15.1 | 12.8 |
| PAA | 5.4 | 6.5 | 6.3 | 5.9 |
| AO | 13.0 | 8.0 | 8.4 | 7.3 |

| FORMULATION | 5 | 6 | 7 | 8 | 9 | 10 | 11 |
|---|---|---|---|---|---|---|---|
| ACETIC ACID | 40 | 35 | 30 | 40 | 35 | 35 | 35 |
| H202 (35%) | 40 | 50 | 50 | 50 | 35 | 45 | 60 |
| DEQUEST 2010 | 1 | 1 | 1 | 1 | 1 | 1 | 1 |
| H2O | 19 | 14 | 19 | 9 | 29 | 19 | 4 |
| AA/H202 (MOLES) | 1.62 | 1.13 | 0.97 | 1.30 | 1.62 | 1.26 | 0.94 |
| EQUILIBRIUM CONCENTRATION, % CALCULATED (b) | | | | | | | |
| ACETIC ACID | 32.8 | 27.3 | 23.6 | 30.9 | 29.6 | 28.1 | 25.7 |
| H202 (100%) | 9.9 | 13.1 | 13.9 | 12.4 | 9.2 | 11.8 | 15.7 |
| H2O | 47.6 | 49.2 | 53.8 | 44.6 | 53.8 | 50.7 | 46.2 |
| PAA | 9.2 | 9.8 | 8.1 | 11.5 | 6.8 | 8.8 | 11.8 |
| AO | 6.6 | 8.2 | 8.2 | 8.2 | 5.8 | 7.4 | 9.9 |
| AA/PAA (MOLES) | 4.52 | 3.53 | 3.69 | 3.40 | 5.51 | 4.04 | 2.76 |
| EQUILIBRIUM CONCENTRATION, % FOUND (c) | | | | | | | |
| H202 (100%) | 10.1 | 13.3 | 14 | 12.4 | 9.5 | 12 | 15.7 |
| PAA | 9.2 | 10 | 8.2 | 11.8 | 6.9 | 8.8 | 12.3 |
| AO | 6.7 | 8.4 | 8.3 | 8.3 | 5.9 | 7.5 | 10 |

AA = acetic acid, PAA = peracetic acid, AO = active oxygen
(a) Oxonia
(b) Formulations were calculated using an equilibrium constant of 2.0
(c) After 7–14 days TABLE III(a)

STABILITY OF PERACETIC ACID FORMULATIONS - ROOM TEMPERATURE % PERACETIC ACID

| Form'n | Initial (Days) | 3 Months (Days) | 6 Months (Days) | 9 Months (Days) | 12 Months (Days) |
|---|---|---|---|---|---|
| 1 (a) | 5.4 (10) | 4.8 (104) | 5.6 (188) | 5.1 (279) | 5.1 (372) |
| 2 | 6.5 (10) | 6.8 (115) | 6.9 (199) | 7.0 (257) | 7.0 (354) |
| 3 | 6.3 (12) | 6.5 (105) | 6.3 (189) | 6.7 (287) | 6.6 (344) |
| 4 | 5.9 (10) | 6.1 (105) | 5.9 (189) | 6.1 (287) | 5.9 (344) |

Working Example 6

A series of experiments in a low temperature warewash machine were carried out to compare the effect of OXONIA and a modified formulation (Formulation 2), when they are used as sanitizers on silver plate. Oneida silver plated knives and spoons were placed in the warewashing machine and put through a series of wash and rinse cycles. Ultra Klene Plus (liquid) and Ultra Dry were used as the detergent and rinse aid, respectively, in city water to 120–140° F. The sanitizer was added during the rinse cycle. The rinse solution was titrated to confirm the levels of peracetic acid and hydrogen peroxide used. After 1, 5 and 10 cycles at least one spoon and one knife were removed and examined to note any changes. The results of these experiments are summarized in the accompanying table.

In experiments using OXONIA as the sanitizer the silverware was corroded after 10 cycles of exposure to either 100 ppm or 50 ppm of peracetic acid. Even the use of OXONIA at the 1 oz/16 gal level (25 ppm peracetic acid) , a level below that required for sanitization, gave evidence of corrosion after 10 cycles.

Formulation 2, however, when used at its minimum level for sanitization (1 oz/12 gal, 42 ppm peracetic acid), gave surprisingly, no indication of corrosion after 10 cycles.

Another series of experiments was performed using hydrogen peroxide alone at a concentration of 540 ppm in the in rinse solution. This is the same level of $H_2O_2$ that would be present when OXONIA is used at the 1 oz/4 gal level. After 10 cycles the knives and spoons were slightly tarnished but were not as seriously damaged as the silverware sanitized with OXONIA. This result indicated that it is the combination of hydrogen peroxide and peracetic acid that probably causes the corrosion. These experiments are summarized in Table IV.

TABLE IV

EFFECT OF PERACETIC ACID AND SANITIZERS ON SILVER PLATE

| USE LEVEL oz/gal | POAA/ppm(a) | CYLCLE | RESULT |
|---|---|---|---|
| | OXONIA (Preliminary Experiment) | | |
| 1/4 | 100 | 1 | Spoons turned brown |
| | | 5 | Spoons dark brown, corroded<br>Knife handle brow |
| 1/8 | 50 | 1 | Spoon light yellow<br>knife - more spots on handle |
| | | 5 | Spoons turned brown |
| | | 10 | Spoons dark brown, corroded<br>Knife handle yellow |
| | H202 (35%) | | |
| 1/5 | 540(b) | 1 | Spoon - slight tarnish<br>Knife - few spots |
| | | 5 | Knife, spoon - slight tarnish |
| | | 10 | Spoon - slight yellow<br>Knife handle - slight tarnish |
| | Formulation 2 | | |
| 1/12 | 42 | 1 | Few spots, no corrosion |
| | | 5 | Powdery film on knife - no corrosion |
| | | 10 | Light film on spoon and knife handle<br>Silverware still glossy - no corrosion |
| | OXONIA | | |
| 1/4 | 100 | 1 | Knife - light film handle, spoon - yellow tint |
| | | 5 | Brown tint on spoon and knife handle<br>Small spots on knife<br>No gloss on silverware |
| | | 10 | Spoon purple, knife handle brown - corroded |
| 1/8 | 50 | 1 | Knife handle - few spots<br>Spoon - yellow tint, spots |
| | | 5 | spoon - brown (corroded)<br>Knife handle - powdery film<br>No gloss on silverware |
| | | 10 | Spoon and knife handle corroded |
| 1/16 | 25 | 1 | Knife handle - few spots<br>Spoon - light yellow tint |
| | | 5 | Knife handle - more spots<br>Spoon - light brown, still glossy |
| | | 10 | Tarnish on knife handle<br>Spoon slightly corroded<br>No gloss on silverware |

(a) POAA = peroxyacetic acid
(b) This is the same level of H202 obtained when OXONIA is used at 1 oz/4 gal

Working Example 7

An AOAC Sanitizing test was performed for the OXONIA formulation against *Staphylococcus aureus* with a 30 second exposure time at 120° F. All samples were prepared in 500 ppm synthetic hard water at concentrations of 1 oz/8 gal, 1 oz/10 gal, and 1 oz/12 gal. All testing was performed in triplicate on two different test dates. Products were prepared as follows:

| | |
|---|---|
| 1 oz/8 gal = 0.098% = 0.98 ml/999.02 ml | (LA) = 0.49 ml/499.51 ml (DL) |
| 1 oz/10 gal = 0.078% = 0.78 ml/999.22 ml | (LA) = 0.39 ml/499.61 ml (DL) |
| 1 oz/12 gal = 0.065% = 0.65 ml/999.35 ml | (LA) = 0.33 ml/499.67 ml (DL) |

Results showed that 1 oz/8 gal in all cases produced no survivors and a >5.0 log reduction. Results at 1 oz/10 gal showed survivors in 3 of the 4 tests with >5.0 log reduction being achieved in 3 of the 4 tests. Results at 1 oz/12 gal showed survivors in 3 of the 4 tests and >5.0 log reduction in only 2 of these tests. These results show that a concentration of 1 oz/8 gal is needed for low temp (120° F.) warewashing sanitizing.

| SAMPLE ID | % H202 | % POAA | H202 Average STD % RSD | % POAA Average STD % RSD |
|---|---|---|---|---|
| 1(b) | 25.55 | 4.91 | | |
| | 25.55 | 4.94 | 25.53 | 5.00 |
| | 25.50 | 5.04 | 0.02123 | 0.0747 |
| | 25.53 | 5.10 | 0.08313 | 1.49 |
| 1(c) | 25.38 | 5.13 | | |
| | 25.37 | 5.27 | 25.42 | 5.24 |
| | 25.40 | 5.40 | 0.05611 | 0.107 |
| | 25.51 | 5.15 | 0.2208 | 2.05 |
| 1(d) | 27.43 | 5.70 | 27.37 | 5.87 |
| | 27.30 | S.94 | 0.05227 | 0.120 |
| | 27.37 | 5.97 | 0.1910 | 2.04 |
| 1(e) | 27.13 | 5.77 | 27.09 | 5.67 |
| | 27.10 | 5.73 | 0.03234 | 0.114 |
| | 27.05 | 5.51 | 0.11934 | 2.02 |

Working Example 8

Test Procedure:

An AOAC sanitizing test was performed for Modified OXONIA formulations. Testing was performed against *Staphylococcus aureus*. Test substance was prepared in 500 ppm synthetic hard water at a concentration of 1 oz/12 gal which is 0.065% (0.65 m/999.35 ml diluent). Neutralizer used was concentrated 1% sodium thiosulfate+1% peptone+10% catalase. The plating medium used was tryptone glucose extract agar with a post-test incubation at 37° C. for 48 hours.

Batches of each product were submitted to analytical and were tested in triplicate. The analytical report is attached. Calculated equilibrium concentrations for these formulations are as follows:

| FORMULATION # | % ACTIVE INGREDIENT |
|---|---|
| 3 | 18.1% Acetic Acid<br>15.4% H202<br>6.3% POAA |
| 4 | 20.3% Acetic Acid<br>13.1% H202<br>6.0% POAA |

| SAMPLE | POST-TEST PH | DAY-1 SURVIVORS (cfu/ml) | AVERAGE (cfu/ml) | LOG REDUCTION |
|---|---|---|---|---|
| 3 | 5.98 | <10<br><10<br><10 | <10 | >5 |
| 3 | 6.02 | <10<br><10<br><10 | <10 | >5 |

-continued

| SAMPLE | POST-TEST PH | DAY-1 SURVIVORS (cfu/ml) | AVERAGE (cfu/ml) | LOG REDUCTION |
|---|---|---|---|---|
| 3 | 5.93 | <10<br><10<br><10 | <10 | >5 |
| 4 | 5.60 | <10<br><10<br><10 | <10 | >5 |
| 4 | 5.69 | <10<br><10<br><10 | <10 | >5 |
| 4 | 5.61 | <10<br><10<br><10 | <10 | >5 |

Numbers control=80, 59, $74\times10^6=7.1\times10^7$

DAY-2

| SAMPLE | POST-TEST PH | SURVIVORS (cfu/ml) | AVERAGE (cfu/ml) | LOG REDUCTION |
|---|---|---|---|---|
| 3 | — | $3.00\times10^1$<br><10<br>$4.00\times10^1$ | $2.33\times10^1$ | >5 |
| 3 | — | $1.00\times10^1$<br>$1.00\times10^1$<br>$4.00\times10^1$ | $2.00\times10^1$ | >5 |
| 3 | — | <10<br>$5.00\times10^1$<br>$5.00\times10^1$ | $3.33\times10^1$ | >5 |
| 4 | — | $5.40\times10^2$<br>$5.70\times10^2$<br>$4.30\times10^2$ | $5.13\times10^2$ | >5 |
| 4 | — | $1.30\times10^2$<br>$1.70\times10^2$<br>$2.80\times10^2$ | $1.93\times10^2$ | >5 |
| 4 | — | $1.40\times10^2$<br>$2.30\times10^2$<br>$3.00\times10^2$ | $2.23\times10^2$ | >5 |

Conclusions:

Results showed greater than 5 log reduction for both formulations. Analytical data corresponded very closely to calculated equilibrium concentrations.

| SAMPLE ID | % H202 | % POAA | | % H202 | % POAA |
|---|---|---|---|---|---|
| 3 | 14.7 | 6.48 | Average | 14.7 | 6.53 |
| | 14.7 | 6.62 | STD | 0.00393 | 0.0762 |
| | 14.7 | 6.50 | % RSD | 0.0268 | 1.17 |
| 3 | 14.5 | 6.24 | Average | 14.5 | 6.17 |
| | 14.4 | 6.10 | STD | 0.0466 | 0.0729 |
| | 14.5 | 6.16 | % RSD | 0.322 | 1.18 |
| 3 | 14.5 | 6.25 | Average | 14.4 | 6.16 |
| | 14.4 | 6.14 | STD | 0.624 | 0.0666 |
| | 14.3 | 6.13 | % RSD | 0.322 | 1.06 |
| 4 | 12.2 | 6.10 | Average | 12.2 | 5.97 |
| | 12.1 | 5.89 | STD | 0.0650 | 0.110 |
| | 12.3 | 5.93 | % RSD | 0.532 | 1.84 |
| 4 | 12.2 | 5.75 | Average | 12.3 | 5.76 |
| | 12.3 | 5.86 | STD | 0.0599 | 0.0308 |
| | 12.3 | 5.68 | % RSD | 0.489 | 0.535 |
| 4 | 12.3 | 5.73 | Average | 12.4 | 5.77 |
| | 12.4 | 5.78 | STD | 0.866 | 0.0308 |
| | 12.5 | 5.79 | % RSD | 0.698 | 0.535 |

Working Example 9

Test Procedure:

A Germicidal and Detergent Sanitizing Action of Disinfectants Test was performed. Test parameters were as follows:

| | |
|---|---|
| Test Systems: | *Staphylococcus aureus* ATCC 6538<br>*Escherichia coli* ATCC 11229 |
| Test Temperature: | 120° F. |
| Test Exposure Time: | 30 seconds |
| Neutralizer: | 1% Sodium Thiosulfate + 1% Peptone + 0.025% Catalase |
| Plating Medium: | Tryptone Glucose Extract Agar |
| Incubation Temperature/Time: | 37° C. for 48 hours |

Test Substance Identification:

| FORMULATION # | DILUENT | CONCENTRATION |
|---|---|---|
| 2(a) | 500 ppm hard water | 1 oz/10 gal = 0.078% = 0.78 ml/999.22 ml diluent<br>1 oz/12 gal = 0.65% = 0.65 ml/999.35 ml diluent<br>1 oz/14 gal = 0.56% = 0.56 ml/999.44 ml diluent<br>1 oz/16 gal = 0.049% = 0.49 ml/999.51 ml diluent |
| 2(b) | 500 ppm hard water | Same as above formulation but freshly prepared |

Results:

*Staphylococcus aureus* ATCC 6538

| SAMPLE # | CONC. | POST-TEST PH | SURVIVORS (cfu/ml) | AVERAGE (cfu/ml) | LOG REDUCTION |
|---|---|---|---|---|---|
| 2(a) | 1 oz/10 gal | 4.88 | <10<br><10<br><10 | <10 | >5 |
| 2(a) | 1 oz/12 gal | 5.21 | <10<br><10<br><10 | <10 | >5 |
| 2(a) | 1 oz/14 gal | 5.70 | <10<br><10<br>$9.20 \times 10^2$ | $3.07 \times 10^2$ | >5 |
| 2(a) | 1 oz/16 gal | 6.09 | $3.00 \times 10^4$<br>$1.23 \times 10^5$<br>$2.70 \times 10^4$ | $6.00 \times 10^4$ | 3.90 |
| 2(b) | 1 oz/10 gal | 4.92 | <10<br><10<br><10 | <10 | >5 |
| 2(b) | 1 oz/12 gal | 4.96 | <10<br><10<br><10 | <10 | >5 |
| 2(b) | 1 oz/14 gal | 5.01 | <10<br><10<br><10 | <10 | >5 |
| 2(b) | 1 oz/16 gal | 5.45 | <10<br><10<br><10 | <10 | >5 |

*Escherichia Coli* ATCC 11229

| SAMPLE # | CONC. | POST-TEST PH | SURVIVORS (cfu/ml) | AVERAGE (cfu/ml) | LOG REDUCTION |
|---|---|---|---|---|---|
| 2(a) | 1 oz/10 gal | 4.88 | <10<br><10<br><10 | <10 | >5 |
| 2(a) | 1 oz/12 gal | 5.21 | <10<br><10<br><10 | <10 | >5 |
| 2(a) | 1 oz/14 gal | 5.70 | <10<br><10<br><10 | <10 | >5 |
| 2(a) | 1 oz/16 gal | 6.09 | <10<br><10<br><10 | <10 | >5 |

Numbers Control=29, 18, $21\times10^7=2.27\times10^8$

Conclusions:

Results showed that the fresh sample of Formulation 2(b) achieved greater than five log reductions with no survivors regardless of the concentration against *Staphylococcus aureus*. The aged sample (2a) showed slightly reduced activity with a greater than five log reduction achieved at 1 oz/14 gal but not at 1 oz/16 gal against *Staphylococcus aureus*. Higher pH values were also recorded for 2a, which may have attributed to the decreased efficacy. Greater than five log reductions were achieved with formulation 2a against *Escherichia coli* regardless of the concentration.

Working Example 10

The objective of the analysis was to determine the sanitizing efficacy of OXONIA Active and Modified OXONIA at pH 8.00 at various concentrations.

Test Procedure:

| | |
|---|---|
| Test Method: | SOP Method CB990-04 Germicidal and Detergent Sanitizing Action of Disinfectants - Final Action |
| Test System: | *Staphylococcus aureus* ATCC 6538 |
| Test Exposure Time: | 30 seconds |
| Test Temperature: | 120° F. |
| Test Substance: | OXONIA Active - Formulation 1(a)<br>Modified OXONIA - Formulation (2) |
| Substance Concentration: | OXONIA Active<br>1. 1 oz/6 gal = 0.130% = 1.30 ml/998.70 ml diluent<br>2. 1 oz/8 gal = 0.098% = 0.98 ml/999.02 ml diluent<br>3. 1 oz/10 gal = 0.078% = 0.78 ml/999.22 ml diluent<br>Modified OXONIA<br>1. 1 oz/8 gal = 0.098% = 0.98 ml/999.02 ml diluent<br>2. 1 oz/10 gal = 0.078% = 0.78 ml/999.22 ml diluent<br>3. 1 oz/12 gal = 0.065% = 0.35 ml/999.35 ml diluent |
| Test Substance Diluent: | 500 ppm synthetic hard water |
| Neutralizer: | 1% Sodium Thiosulfate + 1% Peptone + 0.025% Catalase |
| Plating Medium: | Tryptone Glucose Extract Agar |
| Incubation Parameters: | 37° C. for 48 hours |

Results:

| *Staphylococcus aureus* ATCC 6538 | | | | | |
|---|---|---|---|---|---|
| TEST SAMPLE | CONC. | ADJUSTED PH | SURVIVORS (cfu/ml) | AVERAGE (cfu/ml) | LOG R |
| Oxonia Active | 1 oz/6 gal | 7.98 | <10<br><10<br><10 | <10 | >5 |
| Oxonia Active | 1 oz/8 gal | 7.97 | $87\times10^1$<br>$54\times10^1$<br>$149\times10^1$ | $97\times10^1$ | >5 |
| Oxonia Active | 1 oz/10 gal | 8.02 | $222\times10^3$<br>$235\times10^3$<br>$136\times10^3$ | $198\times10^3$ | 2.91 |
| Modified Oxonia | 1 oz/8 gal | 8.00 | <10<br><10<br><10 | <10 | >5 |
| Modified Oxonia | 1 oz/10 gal | 8.02 | <10<br><10<br><10 | <10 | >5 |
| Modified Oxonia | 1 oz/12 gal | 8.05 | $26\times10^1$<br>$40\times10^1$<br>$18\times10^1$ | $28\times10^1$ | >5 |

Numbers Control: 168, 144, $171\times10^6$=$161\times10^6$ cfu/ml

Results for OXONIA Active at pH 8.00 showed that at a concentration of 1 oz/8 gal, borderline passing results were achieved (Log R=5.22), and at 1 oz/10 gal a log reduction of 2.91 was observed. Best activity was observed at 1 oz/6 gal, where no survivors were present and >5 log reduction was observed.

Results for Modified OXONIA showed greater than 5 log rejection regardless of the concentration. However, at 1 oz/12 gal, survivors were present.

The objective of the analysis was to determine the sanitizing efficacy of warewashing solutions containing Modified OXONIA diluted in soft water at concentrations of 1 oz/10 gal and 1 oz/12 gal.

Working Example 11

| | |
|---|---|
| Test Method: | SOP Method CB990-04 Germicidal and Detergent Sanitizing Action of Disinfectants - Final Action |

-continued

| | |
|---|---|
| Test System: | *Staphylococcus aureus* ATCC 6538<br>*Escherichia coli* ATCC 11229 |
| Test Exposure Time: | 30 seconds |
| Test Temperature: | 120° F. |
| Test Substance: | Modified OXONIA - Formulation (2) |
| Substance Concentration: | 1. 1 oz/10 gal = 5 ml/rack<br>2. 1 oz/12 gal = 4.2 ml/rack<br>Test substance was run through a normal dishmachine cycle at the stated concentration. Solutions contained rinse additives to simulate field situations. |
| Test Substance Diluent: | Soft Water |
| Neutralizer: | 1% Sodium Thiosulfate + 1% Peptone + 0.025% Catalase |
| Plating Medium: | Tryptone Glucose Extract Agar |
| Incubation Parameters: | 37° C. for 48 hours |

Results:

*Staphylococcus aureus* ATCC 6538

| TEST SAMPLE | CONC. | POST-TEST PH | SURVIVORS (cfu/ml) | AVERAGE (cfu/ml) | LOG R |
|---|---|---|---|---|---|
| Modified Oxonia Cycle 1 | 1 oz/10 gal | 7.76 | <10<br><10 | <10 | >5 |
| Oxonia Active Cycle 2 | 1 oz/10 gal | 7.65 | <10<br><10 | <10 | 22 5 |
| Modified Oxonia Cycle 3 | 1 oz/10 gal | 7.74 | <10<br><10 | <10 | 22 5 |
| Modified Oxonia Cycle 1 | 1 oz/12 gal | 7.90 | <10<br><10 | <10 | 22 5 |
| Modified Oxonia Cycle 2 | 1 oz/12 gal | 7.82 | <10<br><10 | <10 | 22 5 |
| Modified Oxonia Cycle 3 | 1 oz/12 gal | 7.81 | <10<br>$12\times10^1$ | $6\times10^1$ | |

Numbers Control=98, 127, $119\times10^6$=$115\times10^6$ cfu/ml

*Escherichia coli* ATCC 11229

| TEST SAMPLE | CONC. | POST-TEST PH | SURVIVORS (cfu/ml) | AVERAGE (cfu/ml) | LOG R |
|---|---|---|---|---|---|
| Modified Oxonia cycle 1 | 1 oz/10 gal | 7.76 | <10<br><10 | <10 | >5 |
| Modified Oxonia cycle 2 | 1 oz/10 gal | 7.65 | $10\times10^1$<br>$48\times10^1$ | $29\times10^1$ | >5 |
| Modified Oxonia cycle 3 | 1 oz/10 gal | 7.74 | <10<br><10 | <10 | >5 |
| Modified Oxonia Cycle 1 | 1 oz/12 gal | 7.90 | <10<br><10 | <10 | >5 |
| Modified Oxonia Cycle 2 | 1 oz/12 gal | 7.82 | <10<br><10 | <10 | >5 |

-continued

| *Escherichia coli* ATCC 11229 | | | | | |
|---|---|---|---|---|---|
| TEST SAMPLE | CONC. | POST-TEST PH | SURVIVORS (cfu/ml) | AVERAGE (cfu/ml) | LOG R |
| Modified Oxonia Cycle 3 | 1 oz/12 gal | 7.81 | <10<br><10 | <10 | >5 |

Numbers Control=155, 177, $166\times10^6$=$166\times10^6$ cfu/ml

Results showed that Modified OXONIA when diluted with soft water at a concentration of 1 oz/10 gal or 1 oz/12 gal is an effective sanitizer to be used in the warewashing application against *Staphylococcus aureus* and *Escherichia coli.*

Working Example 12

The experiments in the attached Table V were carried out in a ES-2000 low temperature machine using either Ultra Klene (high alkalinity) or Ultra Klene Plus (low alkalinity) as the detergents. Ultra Dry was used as the rinse aid in all cases. Modified OXONIA (Formulation 2) or OXONIA (Formulation 1a) was used as the sanitizer at the dosage rate indicated. The pH of the wash and rinse solution were taken during 3 cycles and the results averaged. The OXONIA experiments were carried out using a temperature of 150° F., whereas the Modified OXONIA was tested at 130° F. Three different types of water were used: soft, city and well. The soft and well water both have a high alkalinity because of the presence of relatively high levels of bicarbonate. For this reason the pH of the rinse solutions are higher when these waters are used. The use of Modified OXONIA at equal concentrations to OXONIA generally results in lower pH. This can be seen most clearly from the results in city water where the residual alkalinity of water is not an issue.

TABLE V

| pH READINGS IN LOW TEMP MACHINE | | | | |
|---|---|---|---|---|
| | Detergent: | | | |
| Dose | Ultra Klene | | Ultra Klene Plus | |
| (oz/gal) | Wash | Rinse | Wash | Rinse |
| MODIFIED OXONIA | | | | |
| Soft Water | | | | |
| 1/10 | 11.2 | 8.2 | 10.5 | 7.6 |
| 1/12 | 11.3 | 8.1 | 10.5 | 7.7 |
| 1/14 | 11.3 | 8.3 | 10.3 | 7.8 |
| City Water | | | | |
| 1/10 | 11.4 | 5.2 | 10.4 | 4.9 |
| 1/12 | 11.4 | 5.6 | 10.7 | 5.O |
| 1/14 | 11.4 | 6.8 | 10.9 | 5.1 |
| Well Water | | | | |
| 1/10 | 11.3 | 8.1 | 10.4 | 7.0 |
| 1/12 | 11.3 | 7.9 | 10.3 | 7.8 |
| 1/14 | 11.1 | 8.2 | 10.3 | 7.8 |
| OXONIA | | | | |
| Soft Water | | | | |
| 0 | 12.1 | 9.6 | 10.9 | 9.6 |
| 1/8 | 11.9 | 7.7 | 10.2 | 7.9 |
| 1/10 | 11.7 | 7.8 | 10.3 | 8.0 |
| 1/12 | 12.1 | 8.4 | 10.4 | 8.3 |

TABLE V-continued

| pH READINGS IN LOW TEMP MACHINE | | | | |
|---|---|---|---|---|
| | Detergent: | | | |
| Dose | Ultra Klene | | Ultra Klene Plus | |
| (oz/gal) | Wash | Rinse | Wash | Rinse |
| City Water | | | | |
| 0 | 12.4 | 10.3 | 11.7 | 9.7 |
| 1/8 | 11.9 | 6.9 | 11.0 | 5.8 |
| 1/10 | 12.1 | 7.3 | 11.2 | 6.8 |
| 1/12 | 12.0 | 7.7 | 11.4 | 7.0 |
| Well Water | | | | |
| 0 | 12.1 | 9.5 | 10.6 | 9.1 |
| 1/8 | 11.6 | 7.5 | 10.1 | 7.5 |
| 1/10 | 11.6 | 7.7 | 10.4 | 7.6 |
| 1/12 | 11.7 | 7.9 | 10.4 | 7.7 |

Since many embodiments of the invention can be made without departing from the spirit and scope of the invention, the invention resides in the claims hereinafter appended.

We claim:

1. A method of sanitizing and destaining ware products comprising:

forming a peroxyacetic acid concentrate composition comprising peroxyacetic acid, acetic acid, hydrogen peroxide, a sequestrant and a carrier, said composition having a storage stability of one year wherein an initial composition having a mole ratio of acetic acid to hydrogen peroxide less than 3:1 results in an equilibrium composition having a mole ratio of acetic acid to peroxyacetic acid less than 5:1; and within the year of storage stability an end user diluting the concentrate composition to a preoxyacetic acid concentration of at least 30 ppm and applying the diluted composition to the ware.

2. The method of claim 1, wherein the composition comprises about 5–12 wt-% of peroxyacetic acid.

3. The method of claim 1 wherein said composition is applied in an automated wash machine.

4. The method of claim 3 wherein said automated wash machine operates at a temperature ranging from about 120° F. to 140° F.

5. The method of claim 4 wherein said ware is washed prior to rinsing.

6. The method of claim 1 wherein said composition is used in a manual procedure.

7. The method of claim 6 wherein said manual procedure applies said composition at a temperature ranging from about 20° C. to 35° C.

8. The method of claim 1 wherein said composition further comprises a surfactant rinse aid.

9. The method of claim 8 wherein said composition and said rinse aid are separately applied during application.

10. The method of claim 1 wherein said carrier is water.

* * * * *

UNITED STATES PATENT AND TRADEMARK OFFICE

CERTIFICATE OF CORRECTION

PATENT NO. : 6,302,968 B1
DATED : October 16, 2001
INVENTOR(S) : Baum et al.

It is certified that error appears in the above-identified patent and that said Letters Patent is hereby corrected as shown below:

Title page,
Item [54], "PRECARBOXYLIC" should read -- PERCARBOXYLIC --

Signed and Sealed this

Fourth Day of June, 2002

*Attest:*

*Attesting Officer*

JAMES E. ROGAN
*Director of the United States Patent and Trademark Office*